US006247298B1

(12) United States Patent
Bourgois et al.

(10) Patent No.: US 6,247,298 B1
(45) Date of Patent: Jun. 19, 2001

(54) STAB-RESISTANT INSERT FOR PROTECTIVE TEXTILE

(75) Inventors: Luc Bourgois, Desselgem; Pol Bruyneel, Wielsbeke; Roger Vanassche, Zwevegem; Frans Van Giel, Otegem, all of (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/227,110

(22) Filed: Jan. 5, 1999

Related U.S. Application Data

(62) Division of application No. 08/783,075, filed on Jan. 15, 1997, now Pat. No. 5,883,018.

(30) Foreign Application Priority Data

Feb. 1, 1996 (EP) ..... 96 200 228

(51) Int. Cl.[7] ..... D04B 1/28

(52) U.S. Cl. ..... 57/902; 57/212; 57/213; 57/214; 57/218; 57/231; 57/237

(58) Field of Search ..... 57/902, 237, 212, 57/213, 214, 218, 231

(56) References Cited

U.S. PATENT DOCUMENTS

| | | | | |
|---|---|---|---|---|
| 4,408,444 | | 10/1983 | Bailliever | 57/237 |
| 4,506,500 | * | 3/1985 | Miyauchi et al. | 57/212 |
| 4,516,395 | * | 5/1985 | Palmer et al. | 57/237 |
| 4,644,989 | * | 2/1987 | Chavert et al. | 57/237 |
| 4,953,234 | | 9/1990 | Li et al. | 2/412 |
| 5,062,161 | | 11/1991 | Sutton | 2/169 |
| 5,319,915 | * | 6/1994 | Kobayashi et al. | 57/902 |
| 5,399,418 | | 3/1995 | Hartmanns et al. | 428/218 |
| 5,661,966 | * | 9/1997 | Matsumaru | 57/237 |
| 5,743,078 | * | 4/1998 | Doornaert et al. | 57/212 |
| 5,784,874 | * | 7/1998 | Bruyneel et al. | 57/237 |
| 5,839,264 | * | 11/1998 | Uchio | 57/237 |

FOREIGN PATENT DOCUMENTS

| | | |
|---|---|---|
| 30 23 990 | 1/1982 | (DE) . |
| 44 07 180 | 4/1995 | (DE) . |
| 0 546 962 | 6/1993 | (EP) . |
| 1.335 584 | 7/1963 | (FR) . |
| 26588 * | 2/1994 | (JP) . |
| 84 844 | 11/1983 | (LU) . |

OTHER PUBLICATIONS

Research Disclosure, No. 319, pp. 868–871, Nov. 1990.

* cited by examiner

*Primary Examiner*—John J. Calvert
*Assistant Examiner*—Shaun R. Hueley
(74) *Attorney, Agent, or Firm*—Foley & Lardner

(57) ABSTRACT

A fabric (144) for use as a stab-resistant insert in protective textiles comprises a plurality of steel cords (100). Each of the steel cords (100) comprises a longitudinal axis (102) and two or more steel filaments (104). Each of the steel filaments (104) forme a twisting angle $\alpha$ with the longitudinal axis (102) of the steel cord (100). The steel cords (100) have two or more of such twisting angles which are substantially different from each other so that any penetrating stab or knife is stopped.

7 Claims, 4 Drawing Sheets

STAB-RESISTANT INSERT FOR PROTECTIVE TEXTILE

The application is a division of Ser. No. 08/783,075 Jan. 15, 1997 U.S. Pat. No. 5,883,018.

FIELD OF THE INVENTION

The present invention relates to a fabric for use as a stab-resistant insert in protective textiles such as clothing in general, vests in particular, sail cloths and canvasses.

The present invention also relates to a steel cord specially adapted for use as a reinforcement in such stab-resistant inserts, and more particularly to a multi-strand steel cord, i.e. a steel cord comprising two or more strands of a twisted structure with the strands being twisted with each other.

BACKGROUND OF THE INVENTION

On the one hand, steel cord constructions, in general, and multi-strand steel cord constructions, in particular, are widely known in the art, for example for the reinforcement of rubber tires, conveyor belts, hoses and timing belts.

Protective and bullet-proof clothing, on the other hand, is also widely known in the art. Bullet-proof clothing are commonly reinforced with high-tensile synthetic yarns such as aramide in order to obtain a sufficient bullet-resistance. Synthetic yarns have proved to provide for a sufficient bullet-resistance, but their resistance against stabs and knives has remained insufficient.

SUMMARY OF THE INVENTION

It is an object of the present invention to provide for a fabric for use as a stab-resistant insert in protective textiles.

It is a second object of the present invention to provide for a steel cord which gives sufficient stab-resistance to bullet-proof textiles.

It is a further object of the present invention to provide for a steel cord construction with sufficient elongation to reinforce bullet-proof clothing.

It is another object of the present invention to provide for a steel cord construction which can be manufactured in an economical way.

It is still another object of the present invention to provide for a fabric and a steel cord steel cord construction with a sufficient degree of flexibility.

According to a first aspect of the present invention, there is provided for a fabric for use as a stab-resistant insert in protective textiles. The fabric comprises a plurality of steel cords and each of these steel cords comprises a longitudinal axis and two or more steel filaments. Each of these steel filaments form a twisting angle with the longitudinal axis of the steel cord. These steel cords have two or more, preferably three or more, of such twisting angles which are substantially different from each other.

The fabric can be a woven structure, a knitted structure or a knotted structure.

The fabric is preferably coated with an adhesive.

In case the fabric is a woven structure, the steel cords may form the warp, the weft or the warp and the weft. Non-metallic filaments may bind the warp with the weft.

According to a second aspect of the present invention, there is provided a steel cord comprising two or more strands of a twisted structure with the strands being twisted with each other. At least one of the strands consists of a first group and of a second group. The first group has at least one steel filament and has a first twist pitch, the second group at least two steel filaments and has a second twist pitch. The first twist pitch is substantially different from the second twist pitch. The first group forms together with the second group the strand. At least one of the other strands comprises filaments which are twisted with each other with a third twist pitch which is different from the first twist pitch and which is different from the second twist pitch.

The advantage of the above-mentioned fabric and of the above-mentioned steel cord construction can be explained as follows.

Steel filaments provide an improved resistance against stabs in comparison with synthetic yarns. The greater the filament diameter the greater the stab-resistance. Thick filaments, however, lead to a lack of flexibility.

It has now been discovered that the stab-resistance of a steel filament is at the smallest when the angle between the stab and the filament is a right angle of 90° and that the stab-resistance becomes greater when the angle between the stab and the filament becomes oblique and more different from a right angle. Since it cannot be predicted from what angle of direction a stab will come, a steel cord construction having different twisting angles is suitable for providing the necessary stab-resistance while providing at the same time the required degree of flexibility.

The steel cord for use as a reinforcement of a fabric according to the first aspect of the present invention has at least two, preferably at least three substantially different twist pitches in order to provide for at least three different twisting angles.

Preferably, the filaments which have the substantially different twisting angles appear at least partially at the surface of the steel cord.

The steel cord according to the second aspect of the present invention has three substantially different twisting angles and further comprises at least one strand consisting of a first group and a second group. Such a strand can be designated as an (m+n)-strand. An (m+n)-strand already comprises two different twist pitches (or twisting angles) and can be made in one single step, as has been disclosed in U.S. Pat. No. 4,408,444, which makes it particularly suitable for use as reinforcement of stab-resistant inserts. Further twisting such an (m+n)-strand with another strand may provide for a steel cord which can be made in only two manufacturing steps and which comprises three different twisting angles.

Examples of such an (m+n)-strand are:

2×0.18+2×0.18 twist pitches ∞/8 mm

3×0.15+2×0.15 twist pitches ∞/10 mm

3×0.12+3×0.12 twist pitches ∞/10 mm

3×0.12+2×0.15 twist pitches ∞/10 mm (1 copper wire and two steel wires of 0.12 mm)+2×0.15 twist pitches ∞/10 mm The filament diameters of the invention steel cord range from 0.05 mm to 0.45 mm, the lower limit being dictated by reasons of cost and by reasons of sufficient stab-resistance, the higher limit being dictated by reasons of flexibility.

Since a high tensile strength is not the first requirement to be met by the invention steel cord, the steel filaments may also be made of a stainless steel instead of a more common carbon steel. Also combining of both steel wires and stainless steel wires are possible. Including of a copper wire for shaping the fabric is not excluded. Indeed, the effect of cutting depends upon the material of the wires used: copper wires are cut differently from plain carbon steel wires, plain carbon steel wires are cut differently from stainless steel wires.

In a preferable embodiment of the present invention, all the twisting occurs in the same direction (S or Z), which gives to the total steel cord a higher elongation, and, as a consequence, a higher degree of flexibility and a higher demping potential.

BRIEF DESCRIPTION OF THE DRAWINGS

The invention will now be described in more detail with reference to the accompanying drawings wherein.

DESCRIPTION OF THE PREFERRED EMBODIMENTS OF THE INVENTION

Figure 1:
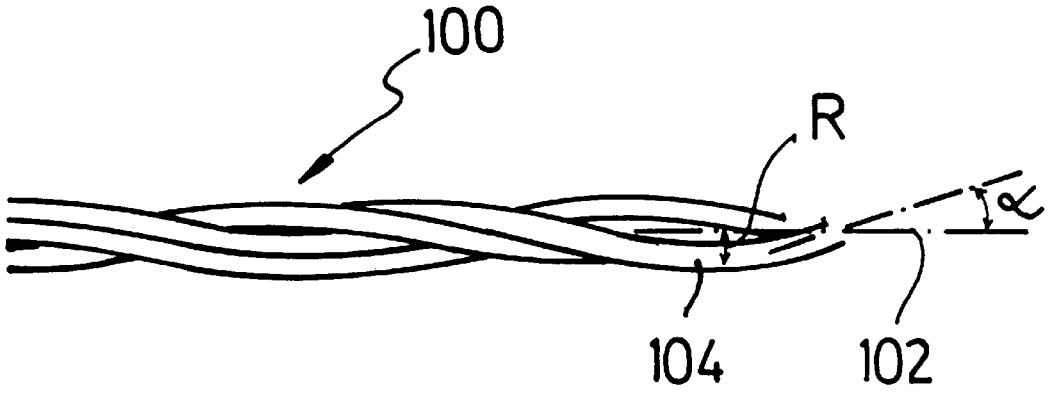
FIG. 1 shows a longitudinal view of a steel cord according to the second aspect of the present invention.

FIG. 1 shows a longitudinal view of a steel cord 100 according to the second aspect of the present invention. The steel cord 100 has a longitudinal axis 102 and several steel filaments 104. Each of the steel filaments 104 forms a twisting angle a with the longitudinal axis 102 of the steel cord 100.

Within the context of the present invention, the twisting angle $\alpha$ of a filament is defined as:

$$\alpha = \text{arctg}\ (2\pi R/p)$$

where R is the radial distance between the center of the filament 104 and the longitudinal axis 102 and where p is the lay length or pitch of the filament 104 in the steel cord 100.

The filaments of a steel cord according to a second aspect of the present invention show two or more substantially different twisting angles $\alpha$. The filaments of single-strand steel cords of the type 1×n, such as a 1×2-cord, a 1×3-cord, a 1×4-cord or a 1×5-cord all have one and the same twisting angle. Their use in a fabric for use as a stab-resistant insert in protective textiles is not excluded, but steel cords having two or more substantially different twisting angles are preferred for the reasons as outlined above.

Figure 2:
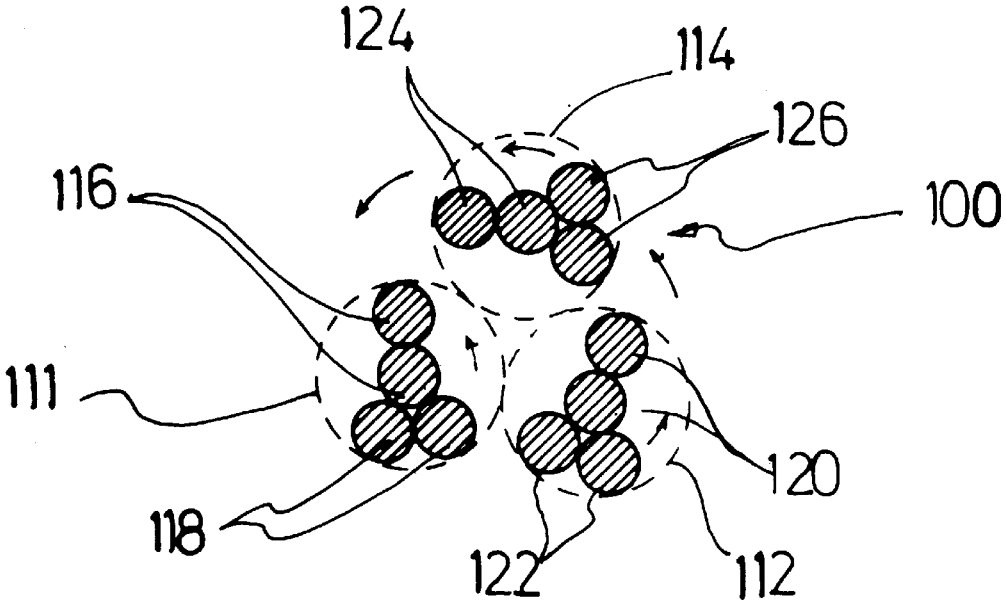
FIG. 2 shows a transversal cross-section of a steel cord according to the second aspect of the present invention.

FIG. 2 shows a transversal cross-section of a steel cord 100 according to the invention. Steel cord 100 comprises three (2+2)-strands 111, 112 and 114.

Strand 111 is consisted of a first group of filaments 116 and of a second group of filaments 118. Filaments 118 are twisted around the first group.

Strand 112 is consisted of a first group of filaments 120 and of a second group of filaments 122. Filaments 122 are twisted around the first group.

In the same way, strand 114 is consisted of a first group of filaments 124 and of a second group of filaments 126. Filaments 126 are twisted around the first group.

In the global invention steel cord 100, strand 111 is not twisted as a whole around itself and strands 112 and 114 are twisted around strand 111 and each twisted around itself.

Such an invention steel cord 100 can be summarized in following formula:

1×[2+2]+2×[2+2] (filament diameter: 0.18 mm)

pitches: ∞/8 8/4 (mm)

cord pitch: 8 (mm)

The symbol "∞" refers to an infinite pitch, which means that the filaments of that particular group are not twisted around each other.

As can be seen, this cord has three different twist pitches resulting in three different twisting angles.

Figure 3:
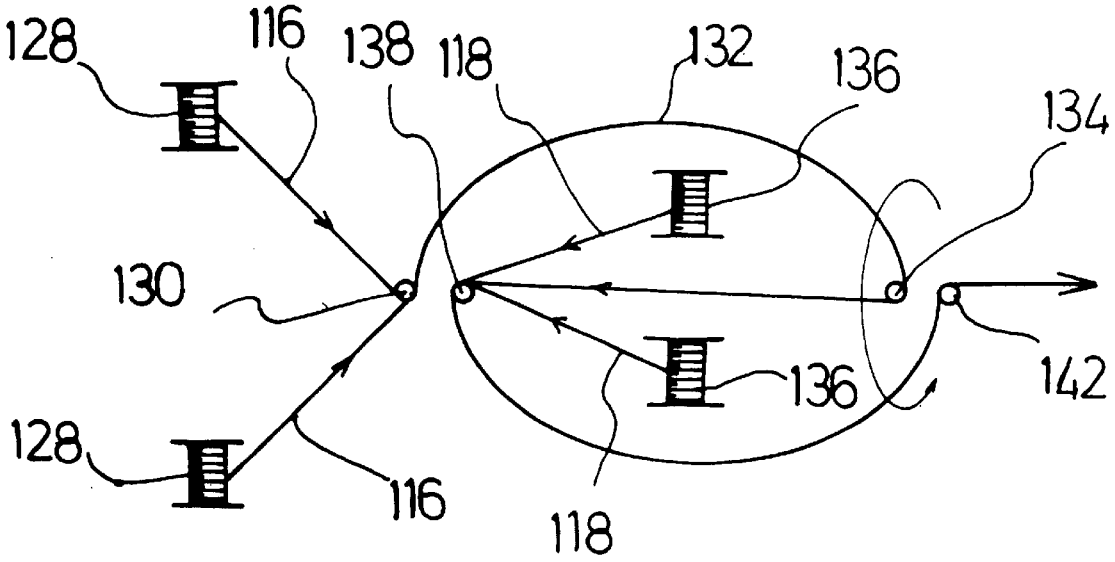
FIG. 3 shows how an (m+n)-strand is manufactured.
Figure 4:
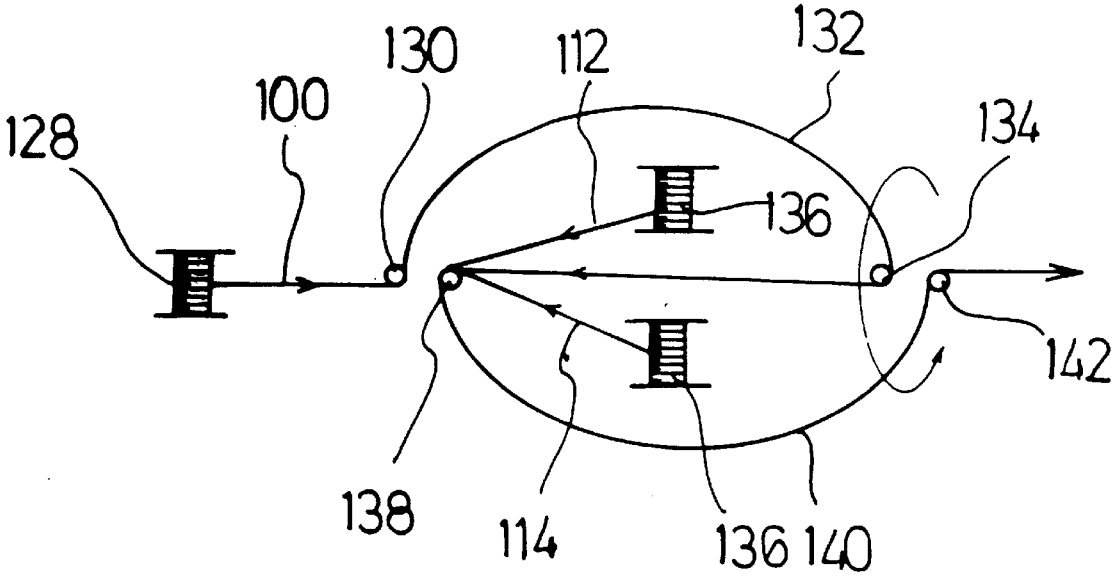
FIG. 4 shows how a steel cord according to the second aspect of the present invention is manufactured starting from (m+n)strands.

FIGS. 3 and 4 illustrate the way of manufacturing such a 1×[2+2]+2×[2+2]-cord.

FIG. 3 illustrates the way of manufacturing the individual [2+2]-strands 111, 112 and 114 and FIG. 3 illustrates the way of manufacturing the global steel cord 100.

Starting at the left side of FIG. 3, outer supply spools 128 deliver the individual filaments 116 (or 120 or 124) to a well-known double-twisting device. Filaments 116 receive two twists in the Z-direction while they are guided over a first guiding pulley 130, over a flyer 132 to a first reversing pulley 134. The provisionally twisted filaments 116 are brought together with filaments 118 (or 122 or 126) which are unwound from inner supply spools 136 and are guided over a second reversing pulley 138, a second flyer 140 and a over a second guiding pulley 142. All filaments 116 and 118 receive two twists in the S-direction. Since flyer 140 rotates necessarily at the same speed as flyer 132, this means that filaments 116 are completely untwisted and that filaments 118 are twisted around each other and around the first group of filaments 116 in S-direction. The result is a [2+2]-strand, which is well known as such: the first group of two filaments 116 being a group of untwisted filaments with a substantially infinite twist pitch, the second group of filaments 118 being a group of twisted filaments. In this single manufacturing step as illustrated in FIG. 3, a steel strand 111 (or 112 or 114) is manufactured with two different twist pitches and with two different twisting angles.

In principle, the same process of FIG. 3 is repeated in FIG. 4. The only basic difference is that in FIG. 4 outer supply spool 128 delivers steel strand 111 and that inner supply spools 136 deliver steel strands 112 and 114. The ultimate result is that steel strand 111 is not twisted around itself, and that steel strands 112 and 114 are each twisted around themselves and around steel strand 111, thereby creating a steel cord with three different twist pitches.

The process of FIG. 4 may be outlined as follows:

strand 111:[2+2] ∞/8S→∞/8S strand 112: [2+2] ∞/8S→8S/4S strand 114: [2+2] ∞/8S→8S/4S The cord pitch is 8 mm (S-direction). It goes without saying that other embodiments of the inventive steel cord are conceivable, a limited number of which are listed here below.

2×[2+2]+2×[2+2]

2×[3+2]+2×[2+2]

2×[2+3]+2×[2+2]

2×[2+2]+2×[3+2]

2×[2+2]+2×[2+3]

2×[3+3]+2×[2+2]

2×[2+2]+2×[3+3]

2×[2+2]+2×1 ∞/8S 4S

1×[2+2]+2×1×3] ∞/8S 4S

2×[2+2]+2×[1×4] ∞/8S 4Z

1×2+2×[2+2]

1×[2+2]+1×[2+2]

2×[2+2+1×[2+2]

FIGS. 5 to 10 all illustrate woven structures 144 according to the first aspect of the present invention.

Figure 5:
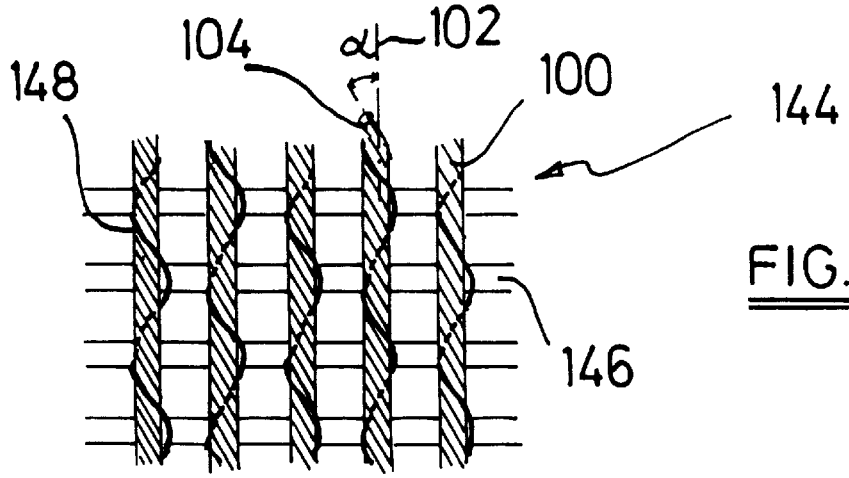
FIGS. 5, 6 and 7 are top views of woven structures according to the first aspect of the present invention.
Figure 6:
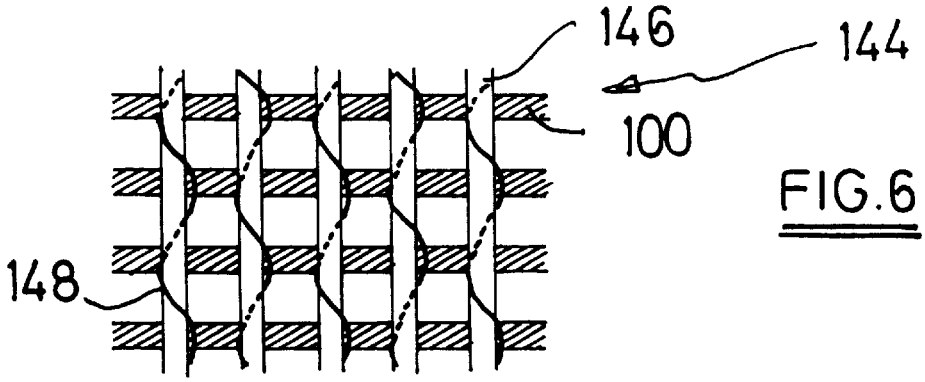

In FIG. 5 steel cords 100 form the warp whereas synthetic yarns 146 such as aramide form the weft. A nylon filament 148, such as nylon 940/2/2 binds the warp to the weft. In FIG. 6 steel cords 100 form the weft whereas synthetic yarns 146 form the warp.

Figure 7:
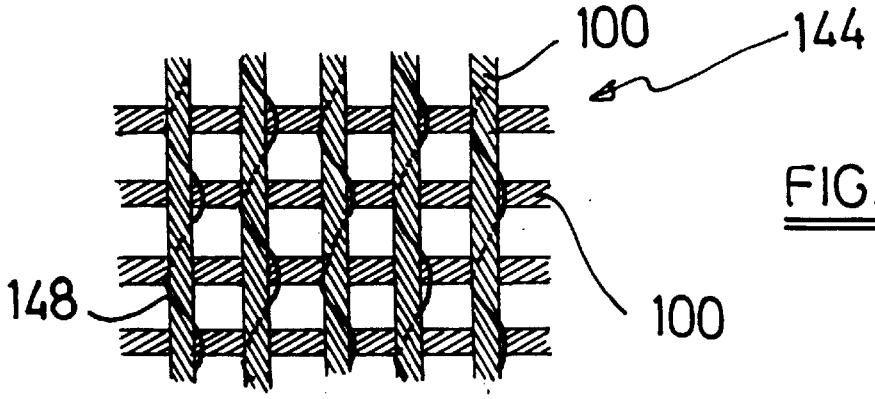

In FIG. 7 steel cords 100 both form the weft and the warp.

Figure 8:
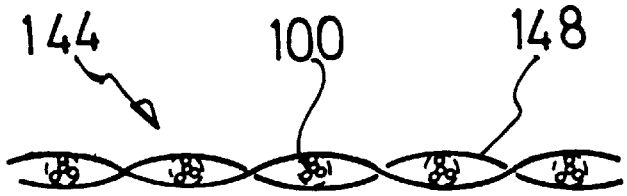
FIGS. 8, 9*a* and 9*b* and 10 are cross-sectional views of woven structures according to the first aspect of the present invention.

In the woven structure 144 of FIG. 8 steel cords 100 form the weft and nylon filaments 148 form the warp in an alternating zigzag way: a first nylon filament 148 goes over and under and over the steel cords 100, a second nylon filament 148 goes under and over and under the steel cords 100, etc . . . .

Figure 9A:
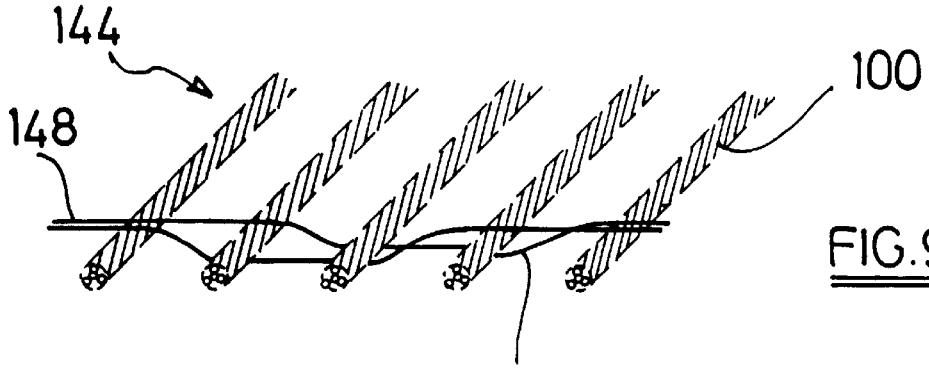
Figure 9B:
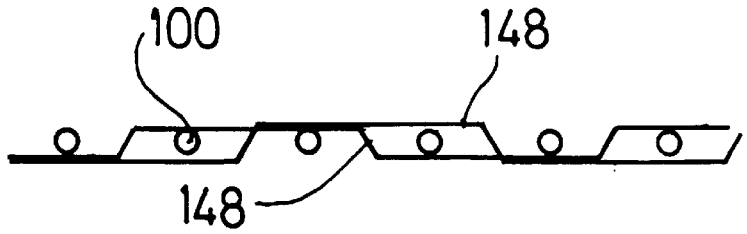

In the woven structure 144 of FIG. 9*a* and 9*b* steel cords 100 form also the weft and nylon filaments 148 also form the warp in an alternating zigzag way, but here the nylon filament 148 goes over two steel cords 100, and subsequently under two steel cords 100 etc . . . in other words, the pitch of the warp nylon filaments is four steel cords instead of two.

Figure 10:
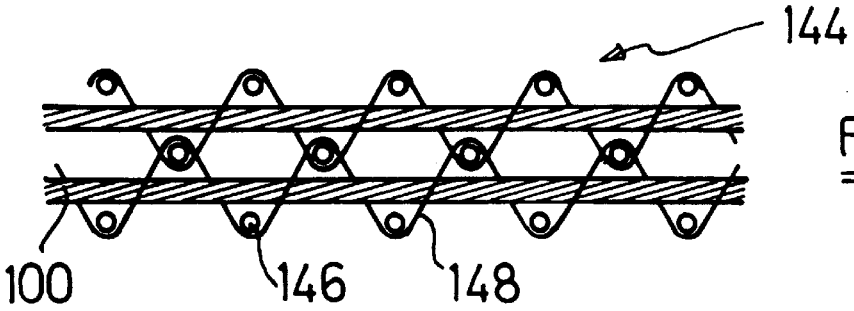

FIG. 10 shows the cross-section of a so-called solid woven structure 144 which exists as such for reinforcement of conveyor belts. Such a solid woven structure has two layers of steel cord as warp, and three layers of synthetic filaments 146 or steel cords as weft. The warp and weft layers are bound by means of nylon filaments 148.

Figure 11:
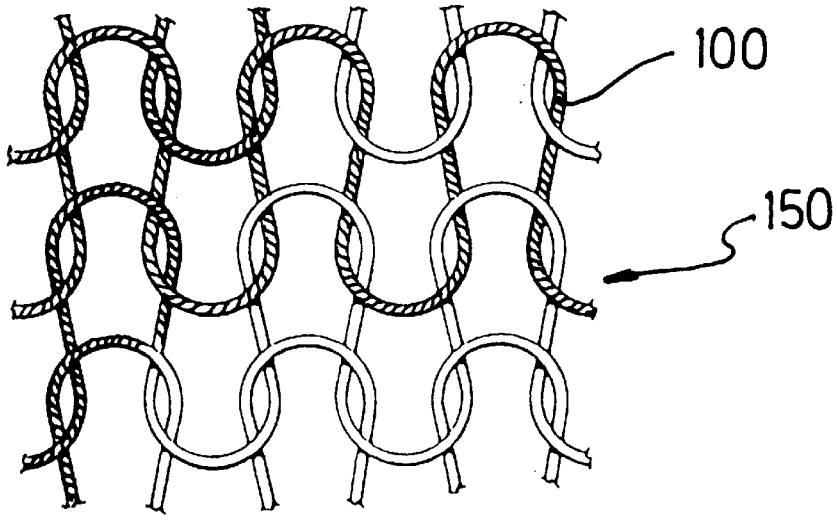
FIG. 11 is a top view of a knitted structure according to the first aspect of the present invention.

FIG. 11 shows a knitted structure 150 where various steel cords 100 have been knitted together.

As stab-resistant inserts, knitted structures are particularly suitable since, in contrast to most woven structures, because the knitted steel cords do not follow a straight one-dimensional line, but form a real three-dimensional structure thereby forming subsequent and different spatial angles for any penetrating stab.

The fabrics according to the first aspect of the present invention or any composing element thereof such as the steel cord, may be provided with a suitable coating or dip which gives to the fabric one or more of the following functions:

an adhesive or binding function which prevents the steel cords from shifting from one another, preferably without making the fabric too stiff to such an extent that it is no longer comfortable or preferably without making the fabric impermeable to air; for example, the fabrics may be impregnated in an elastic rubber, or in polyurethane or in another plastic material, or may be dipped in an elastic varnish;

an anti-corrosion function which protects the fabrics or the elements thereof against corrosion; for example, the individual steel filaments of the steel cord and/or the steel cord as a whole is preferably are covered with a corrosion resistant coating such as a metallic coating of zinc, aluminium or a zinc-aluminium alloy such as a BEZINAL® alloy; synthetic coatings such as nylon or polyethylene may also be provided in addition to the metallic coating or instead of the metallic coatings.

In the final protective textile, conveniently two or more fabrics according to the first aspect of the present invention can be used in different layers where the fabrics have a different orientation in each layer. For example, three different layers with three different orientations can build the well-known triangular structures. In another example, the three layers with the different orientation are woven together in one multi-direction fabric.

What is claimed is:

1. A steel cord comprising: two or more strands of a twisted structure, the strands being twisted with each other;

at least one of the strands comprising a first group and a second group;

the first group including at least one filament, the at least one filament making a first twist angle; and the second group including at least two filaments, the at least two filaments making a second twist angle;

wherein the first twist angle is substantially different from the second twist angle; and at least one of the other strands comprising filaments being twisted with each other and having a third twist angle, the third twist angle being different from the first twist angle and being different from the second twist angle.

2. A steel cord according to claim 1 wherein the first group and the second group both consist of exactly two filaments each.

3. A steel cord according to claim 1 wherein all the other strands also consist of two groups, each group having its own twisting angle.

4. A steel cord according to claim 1, wherein all the different twist angles are positive.

5. A steel cord according to claim 1 wherein the diameters of all the filaments range from 0.05 mm to 0.45 mm.

6. A steel cord according to claim 1 wherein the filaments have been covered with a corrosion resistant coating.

7. A steel cord according to claim 1, wherein all the different twist angles are negative.

* * * * *